United States Patent [19]

Pruyser

[11] Patent Number: 4,688,748

[45] Date of Patent: Aug. 25, 1987

[54] SUPPORT CONSTRUCTION FOR DESK- OR TABLE-TOP

[75] Inventor: Johan S. Pruyser, JC Hoofddorp, Netherlands

[73] Assignee: Ahrend Groep B.V., Amsterdam, Netherlands

[21] Appl. No.: 841,288

[22] Filed: Mar. 19, 1986

[30] Foreign Application Priority Data

Aug. 13, 1985 [NL] Netherlands ..... 8502235

[51] Int. Cl.[4] ..... A47B 91/00

[52] U.S. Cl. ..... 248/188.7; 108/150

[58] Field of Search ..... 108/50, 23, 150; 248/188.7

[56] References Cited

U.S. PATENT DOCUMENTS 3,635,174 1/1972 Ball ..... 108/23 X 4,117,784 10/1978 Piretti ..... 108/150

FOREIGN PATENT DOCUMENTS 0010277 4/1980 European Pat. Off. ..... 108/50

*Primary Examiner*—Andrew V. Kundrat

*Attorney, Agent, or Firm*—Michael N. Meller

[57] ABSTRACT

Support construction for a desk- or table-top, said construction comprising at least one foot consisting of an upper and lower horizontal beam connected by means of force fit to a common vertical post provided with a longitudinally extending channel which is open to the outside and can be closed by a lid for inserting electric cables in said channel. If two feet are used they can be connected by a horizontal beam positioned in the center and near the upper end of said feet.

6 Claims, 8 Drawing Figures

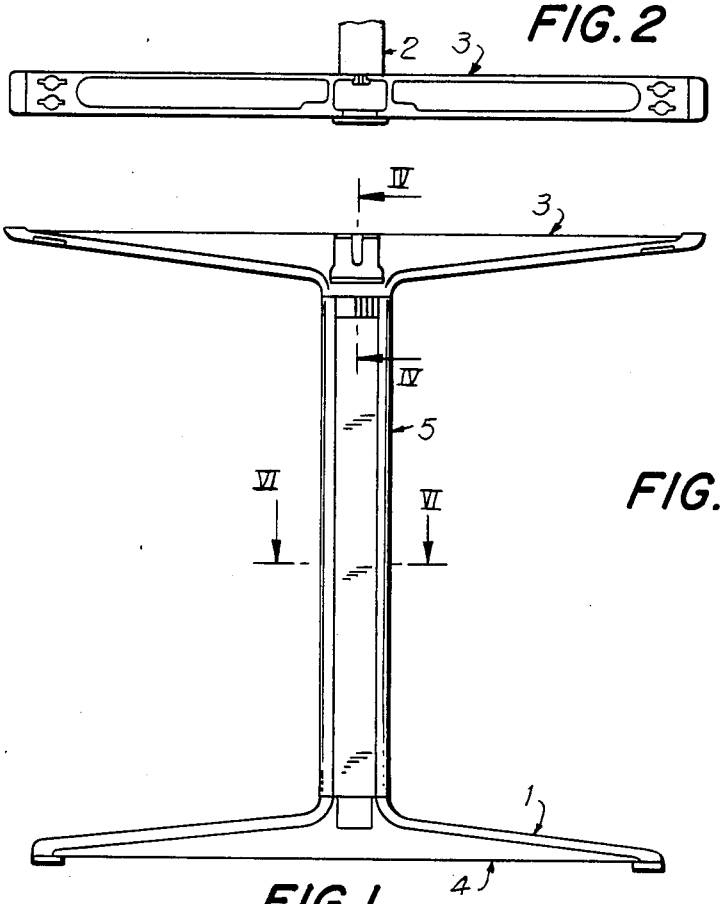
FIG. 2
FIG. 1
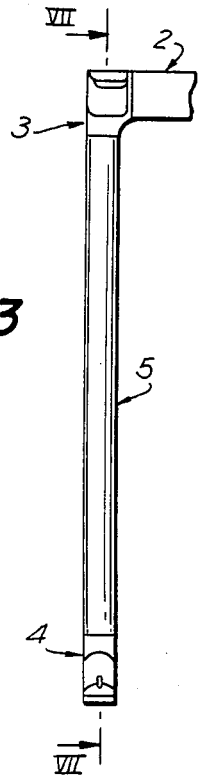
FIG. 3
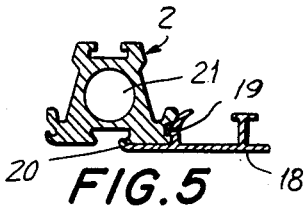
FIG. 5
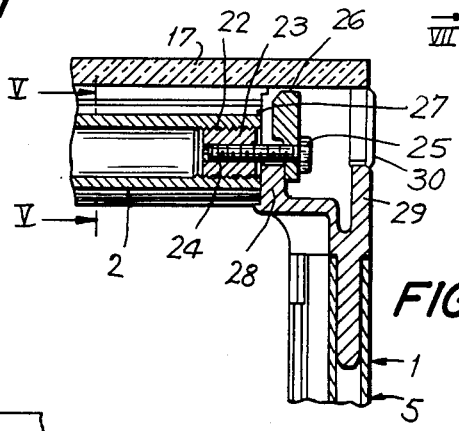
FIG. 4
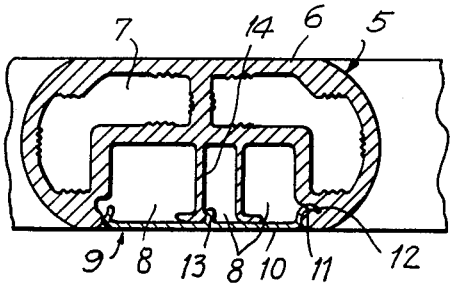
FIG. 6

SUPPORT CONSTRUCTION FOR DESK- OR TABLE-TOP

The invention relates to a support construction for a desk- or table-top, in particular for use in office buildings and the like.

When using desks and tables in office buildings, apparatus are placed thereon at an increasing scale, which by means of electric cables have to be connected to either the line voltage or to other apparatus which are at a different location. These may be, for example, electrical typewriters, word processors, communication apparatus and the like.

In such a case the electric cables should be concealed as much as possible and this not solely from an aesthetic point of view, but also in connection with the possibility of damage to the wiring, such as by objects which are caught behind them while being transported through the relevant room. There is also the risk of personal injury by tripping over loose cables.

In connection therewith, provisions are made on occasion that at specific positions in a floor of a room, located substantially directly underneath a desk- or table-top, connecting points are available for various apparatus. From these points, however, there will still be wires or cables running to the various apparatus, positioned on the desk or the table, said wires or cables partly extending over the floor and causing the above-mentioned disadvantages.

The invention now intends to provide a support construction by which this disadvantage is removed to a large extent.

According to the invention it is provided that the support construction comprises at least one pedestal to be positioned near one side of a top and consisting of an upper and a lower horizontal beam and one vertical post connecting these beams and being provided with at least one longitudinally extending channel which is open to the outside and can be closed by a lid for inserting therein electric cables or the like.

Thus the electric cables extend from a point that is near to the table-top to the apparatus positioned on the table-top, so that it can be prevented that electric cables extend near to or on the floor.

According to a preferred embodiment of the invention, it may be provided that the vertical post is connected to the horizontal beams mainly by force fit. The three parts may then be manufactured separate from each other and be assembled into a unit in a fast and simple manner.

Though in certain cases the desk- or table-top to be supported can be made so rigid that two pedestals according to the invention can be fixed to it directly, the upper beam of a pedestal preferably will be made such that it may be connected, substantially at its center, to a cross beam extending as well in the horizontal direction and perpendicular thereto, which may then interconnect two pedestals.

It has appeared that in this manner a support construction can be obtained, which can be assembled very fast and in an easy manner, and which occupies very little room during transportation, while a very stable construction is still obtained.

With this the cross beam in particular will be obtained by extrusion and in cross-section will have a profiled shape and at least at the ends will be provided with parts with screw-thread. Thereby a connection may be made between a pedestal and the cross beam by means of screws.

In particular, the cross beam will comprise a continuous cavity with at each end thereof a sleeve which is externally provided with screw-thread for mounting it in the cross beam and which is internally provided with screw-thread for accepting a screw by which the connection between cross beam and pedestal may be realized.

In this way the thickness of the wall of the cross beam may be limited, while the stiffness thereof is still adequate. The cavity of the cross beam then, however, has such a large dimension that a screw should not be placed directly in it, so that said sleeve is provided.

Preferably the profile of the cross beam will be carried out such that a snapping connection with a cable gutter can be realized. The cable gutter may extend over the full length or over only a part of the length of the cross beam and will serve for the support of the cables which leave the vertical post at the upper end thereof and are running to the apparatus positioned on the working top.

For fast removal of the lid closing off the channel in the post, and for allowing fast insertion of cables in and for removing them out of the channel, provision may be made that the lid is connected with the vertical post by a snap connection.

The invention will now be elucidated by means of an embodiment, shown in the drawing, in which:

FIG. 1 shows a side view of a support construction according to the invention;

FIG. 2 shows a top view of a part of the construction according to FIG. 1 and in particular of one pedestal and a part of the cross beam;

FIG. 3 shows a front view of a part of the construction according to FIG. 1;

FIG. 4 shows a partial section over the connection between the upper part of a pedestal and a cross beam according to the line IV—IV in FIG. 1;

FIG. 5 shows a cross section over a cross beam and a part of a cable gutter connected therewith, along the line V—V in FIG. 4;

FIG. 6 shows a cross section over a vertical post of a pedestal along the line VI—VI in FIG. 1;

Figure 8:
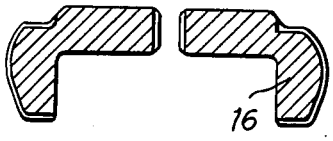
FIG. 8 shows a cross section, taken along line VIII—VIII in FIG. 7, over that part of a horizontal beam of a pedestal that is inserted into the vertical post.

The support construction represented in the drawing and in particular in FIGS. 1–3 thereof, comprises at least one pedestal 1, which is connected to a cross beam 2. The pedestal 1 is composed of an upper horizontal beam 3, a lower horizontal beam 4 and a vertical post 5. In one embodiment a second pedestal (not shown) may be included, cross beam 2 connecting the first and second pedestals.

As appears in particular from FIG. 6, the vertical post 5 comprises a wall 6 with such a shape that two cavities 7 are formed, closed off in the transverse direction, and three cavities 8 are formed, which are open sideways. In the cavities 8 cables or wires may be positioned, whereafter closing off of the cavities 8 may take place by means of the lid 9. The lid 9 consists of the plate 10, one of the longitudinal edges of which is shaped in such a manner that an edge section 11 is obtained, which may be properly positioned into a cavity 12 in the wall 6 of the post 5, while the plate 10 is further provided with a part 13 in an approximately perpendicular position thereto and shaped in such a manner that it may snap behind a part of a wall 14, defining a cavity 8. In this way the lid 9 may be fixed on the post 5 in a simple but firm manner and can easily be removed therefrom.

Figure 7:
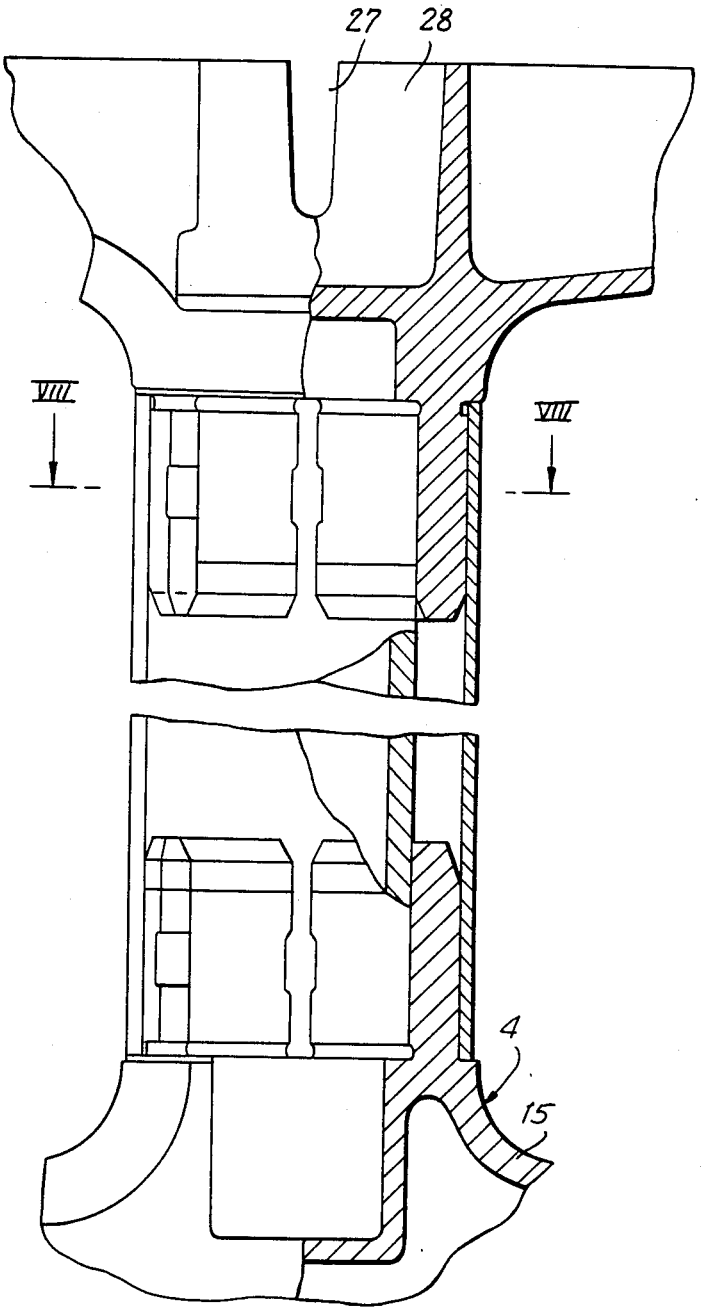
FIG. 7 shows a vertical section and partial front view over a part of a pedestal, omitting the cross beam, substantially along the line VII—VII in FIG. 3.

As appears in particular from FIGS. 4, 7 and 8, the horizontal beams 3 and 4 will be manufactured as castings whereby the vertical parts 16 connect with the substantially horizontal part 15 thereof. The parts 16 have in cross section a substantially square shape, such that when mounting the vertical post 5, parts 16 may be received force-fitted into the cavities 7 of the vertical post which are indicated in FIG. 6.

In this manner a very stable pedestal 1 is obtained.

FIG. 4 shows the connection between the upper horizontal beam 3 and the longitudinal beam 2. It will be obvious that also the other end of the cross beam 2 is connected with a pedestal 1 in the manner shown in FIG. 4. A working top 17 may then be positioned on the structure obtained.

The cross section of the cross beam 2 is represented in FIG. 5. The profile is such that a cable gutter 18 may be affixed thereon in a simple manner, to which purpose the cable gutter is provided with parts 19 and 20 which are approximately perpendicular to each other. The part 19 is inserted into a cavity, not specifically indicated, of the cross beam 2 and the edge 20 snaps over an extending part, not further indicated, of the cross beam 2. In this manner a simple and fast mounting of a cable gutter 18 on the cross beam 2 is possible. A cavity 21 is present in the cross beam. As appears in particular from FIG. 4, an internal screw-thread has been applied at the end of the cross beam 2, into which a sleeve 23 can be screwed which is provided with the internal screw-thread 24 for screwing therein a screw 25. The screw 25 extends further through a closing block 26, which closes the V-shaped groove 27, provided in the side wall 28 of the horizontal beam 3. In this manner an easy mounting of the cross beam is possible, while the surface of the closing block 26 engaging the wall 28 will extend slightly slanted, as the wall 28 also will deviate somewhat from the vertical line in connection with the release of the casted product from the mold. In order to connect a cross beam 2 at the other side of the horizontal beam 3, if wanted, the other side surface 29 of the cross beam is also provided with a groove 27, which in FIG. 4 is closed off by means of an ornamental plate 30.

I claim:

1. A support construction for a top of a desk or table, comprising a first pedestal connected to support said top, said first pedestal comprising an upper horizontal member, a lower horizontal member, and a vertical member connecting said horizontal members, each of said horizontal members having a first vertical part integrally connected to a horizontal part, and said vertical member having first and second longitudinal cavities formed therein, said first longitudinal cavity being open only at the ends of said vertical member and formed to receive said first vertical parts with force-fit and said second longitudinal cavity being formed to receive an electric cable therein by way of a longitudinal opening communicating with said second longitudinal cavity, said longitudinal opening being closable by a lid connected to said vertical member.

2. The support construction as defined in claim 1, further comprising a cross beam having first and second ends, and means for connecting said first end of said cross beam to said upper horizontal member of said first pedestal.

3. The support construction as defined in claim 2, further comprising a second pedestal comprising an upper horizontal member, a lower horizontal member and a vertical member connecting said horizontal members, and further comprising means for connecting said second end of said cross beam to said upper horizontal member of said second pedestal.

4. The support construction as defined in claim 2, wherein said cross beam is made by extrusion and has a profiled cross section.

5. The support construction as defined in claim 2, wherein said cross beam has a longitudinal cavity formed with threads at said first end, and wherein said means for connecting comprises a sleeve having a threaded outer surface and a threaded bore surface and a screw, said screw being adapted to threadedly engage said threaded bore surface of said sleeve and said outer threaded surface of said sleeve being adapted to threadedly engage said threads formed in said longitudinal cavity of said cross beam.

6. The support construction as defined in claim 4, wherein said cross beam is profiled to include a means for snapping engagement with a cable gutter.

* * * * *